US007886554B2

(12) United States Patent
Simoner

(10) Patent No.: US 7,886,554 B2
(45) Date of Patent: Feb. 15, 2011

(54) REFRIGERATOR AND/OR FREEZER COMPRISING A FRAME AND A LID MOVABLE RELATIVE TO THE FRAME

(75) Inventor: Richard Simoner, Nikolsdorf (AT)

(73) Assignee: Liebherr-Hausgeräte Lienz GmbH, Lienz (AT)

( * ) Notice: Subject to any disclaimer, the term of this patent is extended or adjusted under 35 U.S.C. 154(b) by 71 days.

(21) Appl. No.: 11/919,847

(22) PCT Filed: May 4, 2006

(86) PCT No.: PCT/EP2006/004183

§ 371 (c)(1),
(2), (4) Date: Jul. 23, 2009

(87) PCT Pub. No.: WO2006/117219

PCT Pub. Date: Nov. 9, 2006

(65) Prior Publication Data

US 2009/0282851 A1 Nov. 19, 2009

(30) Foreign Application Priority Data

May 4, 2005 (DE) ..... 20 2005 007 188 U

(51) Int. Cl.
*A47F 3/04* (2006.01)

(52) U.S. Cl. ..... 62/248; 49/501; 62/275; 200/61.71; 219/522; 219/552

(58) Field of Classification Search ..... 62/248, 62/275; 49/413, 501; 219/402–408, 520–522, 219/538–548, 552–553; 200/61.62–61.82
See application file for complete search history.

(56) References Cited

U.S. PATENT DOCUMENTS

| | | | | | |
|---|---|---|---|---|---|
| 3,684,860 | A | * | 8/1972 | Snyder | 219/413 |
| 3,760,157 | A | | 9/1973 | Newman et al. | |
| 3,859,502 | A | * | 1/1975 | Heaney | 219/218 |
| 4,065,658 | A | * | 12/1977 | Keim | 219/386 |
| 4,127,765 | A | * | 11/1978 | Heaney | 219/218 |
| 4,248,015 | A | * | 2/1981 | Stromquist et al. | 49/70 |
| 4,285,391 | A | * | 8/1981 | Bourner | 165/61 |
| 4,753,043 | A | * | 6/1988 | Bockwinkel | 49/501 |
| 5,007,246 | A | * | 4/1991 | Kruck et al. | 62/131 |
| 6,114,665 | A | * | 9/2000 | Garcia et al. | 219/404 |
| 6,401,399 | B1 | | 6/2002 | Roche et al. | |
| 2004/0232117 | A1 | | 11/2004 | Gerhardinger et al. | |

FOREIGN PATENT DOCUMENTS

| | | |
|---|---|---|
| DE | 3241622 | 5/1984 |
| DE | 3893201 | 5/1990 |
| DE | 19833958 | 1/2000 |

* cited by examiner

*Primary Examiner*—William E Tapolcai
(74) *Attorney, Agent, or Firm*—Dilworth & Barrese, LLP

(57) ABSTRACT

A chest refrigerator and/or freezer with a carcass and a cover movable relative to the carcass, includes a pane, preferably a pane of glass or plastics, or is formed by the pane, with a heating element provided by which the pane can be heated.

9 Claims, 1 Drawing Sheet

REFRIGERATOR AND/OR FREEZER COMPRISING A FRAME AND A LID MOVABLE RELATIVE TO THE FRAME

BACKGROUND OF THE INVENTION

This invention relates to a chest refrigerator and/or freezer with a carcass and a cover movable relative to the carcass, which includes a pane, preferably a pane of glass or plastics.

Such chest refrigerators and/or freezers are known as commercial chests, such as ice chests. In general, they include a carcass for receiving the goods to be refrigerated and/or frozen, the top side of which can be closed for instance by a slidable cover, which includes a preferably transparent pane, preferably a pane of glass or plastics. One disadvantage of such chests consists in that in particular with increased atmospheric moisture it can occur that the moisture can be deposited on the comparatively cold cover of the chest and hence also on its pane. Such dewing of the cover, however, is undesirable.

SUMMARY OF THE INVENTION

Therefore, it is the object of the invention to develop a chest as mentioned above such that said problem of dewing of the pane of the cover is avoided.

This object is solved by a chest refrigerator and/or freezer with the features herein. Accordingly, it is provided that the chest includes a heating means, by means of which the pane can be heated. In this way, it is possible to prevent dewing of the pane. The type and arrangement of the heating means largely can be chosen as desired. It is conceivable, for instance, to provide an electrically operated, i.e. current-carrying heating means. In an advantageous aspect of the invention, the carcass and the cover of the chest refrigerator and/or freezer include contact elements, by means of which the heating means can be connected with a power source. In such an embodiment, a flow of current, possibly upon actuation of a further switching element, requires that the one or more contact elements of the cover are electrically connected with those of the carcass. Depending on the arrangement of the contact elements, an embodiment can be realized, in which an electrically conducting connection between the contact elements only is effected when the cover completely or at least largely is in its closed position.

Accordingly, it can be provided that in the closed or largely closed condition of the cover the contact elements of the cover are in electrically conducting contact with the contact elements of the carcass.

In a preferred embodiment of the invention it is provided that one or more contact elements are designed such that their position and/or shape can be varied in dependence on the position of the cover. It is conceivable, for instance, to use linearly movable contact elements or resilient tabs, which are moved, bent or tensioned when making contact.

A particularly advantageous embodiment of the invention is obtained in that at least one contact element is a movable contact pin. The contact pin(s) can be spring-loaded (spring contact). It can be provided that the contact pin(s) is(are) retracted when the cover is closed, and is(are) extended by the spring force when the cover is opened. The contact elements can be arranged such that their direction of movement corresponds to that of the cover. When the cover is a sliding cover, it can thus be provided that the direction of movement of the contact pins corresponds to the direction in which the cover is slidable.

In a further aspect of the invention it is provided that at least one contact element is a plate. It is conceivable, for instance, that the cover includes one or more such plates, which in the closed position of the cover or just before reaching the same make an electrically conducting connection with contact pins disposed on the carcass of the chest.

Accordingly, it can be provided that on the carcass or cover of the chest refrigerator and/or freezer two movable pin or spring-loaded contact elements are disposed and on the other part two plate contact elements are disposed.

In a further aspect of the invention a switch is provided, which will only be closed in the closed condition of the cover and in this position closes the electric circuit for energizing the heating means. The switch preferably is disposed on the carcass. Such aspect of the invention effects that a flow of current does not occur already when the contact elements of the cover are connected with those of the carcass, but only when the switch is actuated, which preferably constitutes a microswitch.

Closing the electric circuit by means of a switch only after closing the cover involves the advantage that the contact elements are spared considerably, which leads to a corresponding extension of the useful life.

An embodiment where a flow of current only is effected in the closed condition of the cover also provides an increased safety, as in this embodiment of the invention a flow of current preferably as a result of the switch only closed with closed cover only is effected when the cover is closed and the contact elements no longer are accessible.

As stated above, the type of heating means largely can be chosen as desired. It can be formed for instance by a current-carrying conductor or by a heating foil (nano coating) of the pane.

BRIEF DESCRIPTION OF THE DRAWINGS

Further details and advantages of the invention will be explained in detail with reference to an embodiment illustrated in the drawing, in which.

DESCRIPTION OF THE PREFERRED EMBODIMENTS

Figure 1:
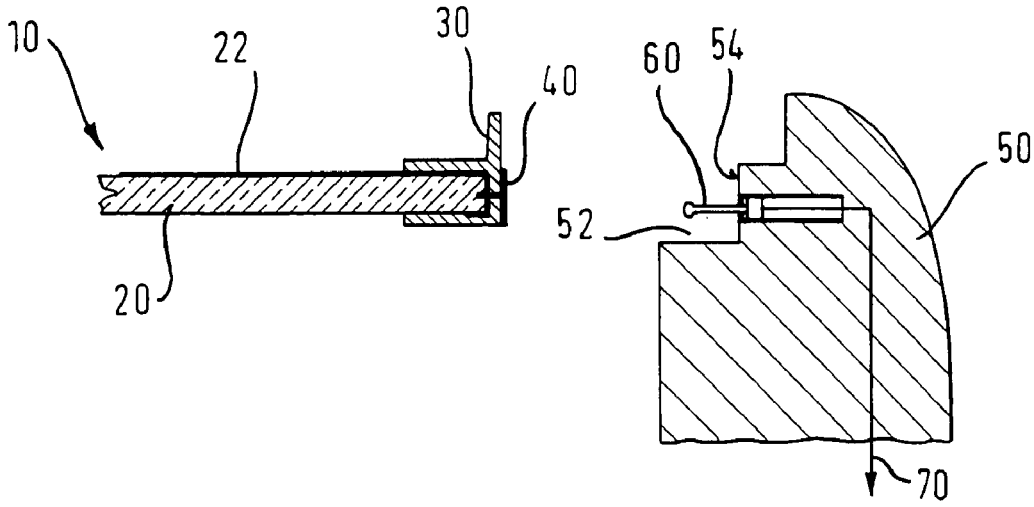
FIG. 1: shows a cross-sectional view of the cover of a chest refrigerator and/or freezer and of the region of the carcass of the chest refrigerator and/or freezer in which the cover rests in the closed condition.

FIG. 1 shows a cross-sectional view of the terminal region of the cover 10 of a chest refrigerator and/or freezer. The cover 10 is slidably mounted and in its closed position closes the carcass of the chest refrigerator and/or freezer. The cover 10 includes a glass plate 20, in whose terminal region shown on the right a handle strip 30 is disposed.

On the upper surface of the glass plate 20, the heating foil or nano coating 22 is provided, which serves as heating means. The same is electrically connected with two contact plates 40 which are provided in the terminal region of the cover 10, which forms the closing region. As is furthermore shown in FIG. 1, the lead connecting the contact plate 40 with the nano coating 22 extends through a bore of the handle strip 30.

FIG. 1 furthermore shows the upper terminal region 50 of the carcass or of a frame of the carcass of the chest refrigerator and/or freezer, in which the cover 10 rests in its closed position. The terminal region 50 includes a step-shaped shoulder 52, against which the cover 10 rests in its closed position. In the vertical wall 54 of the shoulder 52, a spring-loaded contact pin 60 is provided, which is received in a housing located in the terminal region 50 of the carcass. The contact pin 60 is designed to be linearly movable in horizontal direction and in all positions is electrically connected with the supply line 70 which connects the contact pin 60 with a power source (e.g. 12 V d.c.).

Figure 2:
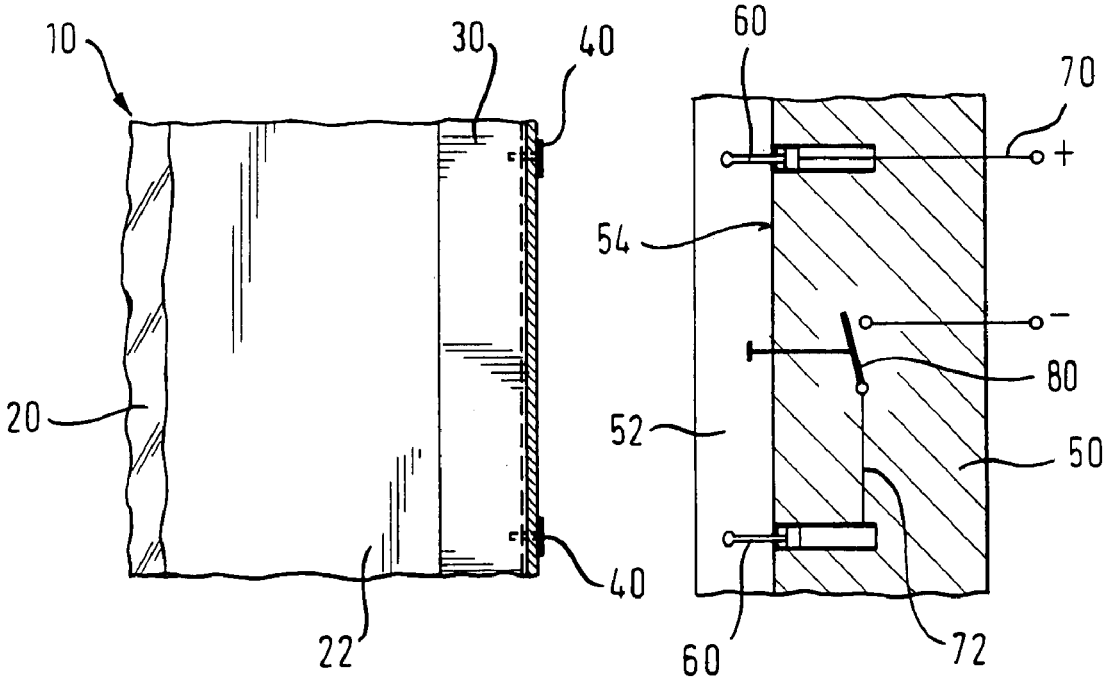
FIG. 2: shows a longitudinal sectional view of the cover and of the region of the carcass as shown in FIG. 1.

FIG. 2 shows the arrangement of FIG. 1 in a longitudinal sectional view. FIG. 2 clearly illustrates that for forming an electric circuit, the cover 10 includes two contact plates 40 and the terminal region 50 of the carcass includes two spring-loaded contact pins 60.

FIG. 2 furthermore shows that the terminal region 50 of the carcass includes a microswitch 80, which is arranged such that it is actuated in the closed position of the cover 10 and closes the electric circuit. The switch 80 is disposed in the line 72 which connects one of the contact pins 60 with the power source.

When the cover 10 is moved to the right from its position shown in FIGS. 1 and 2, i.e. in the direction of its closed position, the two contact plates 40 of the cover 10 come in contact with the contact pins 60 disposed on the carcass of the chest refrigerator and/or freezer. Thereby, the contact pins 60 are retracted into their housing, i.e. moved to the right, as shown in FIGS. 1 and 2. However, a flow of current and thus a heating of the glass plate 20 only is effected when the cover 10 or its handle strip 30 actuates the microswitch 80, which is the case when the cover 10 snaps into its end position. When the switch 80 is actuated, the electric circuit is closed and the current flows through the heating foil or nano coating 22 of the glass plate 20 via the contact pins 60 or the contact plates 40.

The invention claimed is:

1. A chest refrigerator and/or freezer with a carcass and a cover movable relative to the carcass, which includes a pane, preferably a pane of glass or plastics, or is formed by the same, wherein heating means are provided, by which the pane can be heated, the carcass and cover of the chest refrigerator and/or freezer include contact elements by which the heating means is connectable with a power source only when the cover is completely or largely closed, the contact elements additionally comprise movable contact pins (60) configured to extend from a wall (54) of a shoulder (52) at a terminal region (50) of the carcass or frame, said shoulder (52) configured such that the cover (10) rests against the shoulder in closed position and the contact pins (60) being both linearly movable and in contact, in all positions, with supply lines leading to the power source, and a switch is provided, configured to only be closed in completely or largely closed condition of the cover, and in this position closes an electric circuit for energizing the heating means.

2. The chest refrigerator and/or freezer according to claim 1, wherein one or more contact elements are designed such that their position and/or shape can be varied in dependence on the position of the cover.

3. The chest refrigerator and/or freezer according to claim 1, wherein the contact pin(s) is(are) spring-loaded.

4. The chest refrigerator and/or freezer according to claim 1, wherein at least one contact element is a plate.

5. The chest refrigerator and/or freezer according to claim 1, wherein on the carcass or cover of the chest refrigerator and/or freezer, two contact elements are disposed and on the other part two plate contact elements are disposed.

6. The chest refrigerator and/or freezer according to claim 1, wherein the switch is disposed on the carcass of the chest refrigerator and/or freezer.

7. The chest refrigerator and/or freezer according to claim 1, wherein the heating means is formed by a heating foil provided on the pane.

8. The chest refrigerator and/or freezer according to claim 1, wherein the heating means comprise a heating foil or coating (22) on one surface of the pane (20), and the contact elements comprise a contact plate (40) positioned at a longitudinal, terminal end of the cover (10) and having a lead connecting with the foil or coating (22) and extending through a bore in a handle strip (30) disposed at the longitudinal, terminal end of the pane (20).

9. The chest refrigerator and/or freezer according to claim 8, wherein said switch (80) is also situated in the terminal region (50) of the carcass or frame and in one (72) of the supply lines connecting one of the contact pins (60) with the power source.

* * * * *